United States Patent [19]

Pokhis

[11] 4,371,985

[45] Feb. 8, 1983

[54] CONICAL BLADDER

[76] Inventor: Naum Pokhis, 1850 N. Whitley Ave., Apt. 317, Hollywood, Calif. 90028

[21] Appl. No.: 147,110

[22] Filed: May 6, 1980

[51] Int. Cl.[3] ..... A41D 13/06

[52] U.S. Cl. ..... 2/22; 5/443

[58] Field of Search ..... 2/22, 23, 24, 2 R; 5/443, 431; 128/80 R, 89 R

[56] References Cited

U.S. PATENT DOCUMENTS

| | | | |
|---|---|---|---|
| 1,117,168 | 11/1914 | Crowley | 2/24 |
| 3,811,434 | 5/1974 | Jacobson et al. | 128/89 R |
| 3,946,451 | 3/1976 | Spann | 5/443 |
| 4,266,298 | 5/1981 | Graziano | 2/22 |

*Primary Examiner*—Louis Rimrodt

*Attorney, Agent, or Firm*—Ilya Zborousky

[57] ABSTRACT

A device comprising a conical, inflated bladder to be mounted on the back of a user's leg to aid in the distribution of body weight when the user is in a squating or kneeling position.

7 Claims, 15 Drawing Figures

CONICAL BLADDER

BACKGROUND OF THE INVENTION

The present invention relates to special means of clothes and destined for situation wherein a user squats or assumes other postures when the body supports on one or two bent legs. The user very often must squat and stand up many times during his work in industrial facilities, construction sites, for example for parqueting, in agriculture, household and other places. Sometimes it is necessary to kneel and sit on one or two legs so that the buttlock muscle abuts against the rear side of a foot. Such manner of sitting has the disadvantage in that the user gets tired fast because the calf muscles are compressed under the action of body weight whereby normal blood circulation is disturbed, it hurts and the knees are subject to high loads. Although this manner of sitting is acceptable for young people, it becomes more difficult with age increase. The object of the present invention is to reduce specific pressure onto calf muscles, to weaken load onto knees joints and to allow normal functioning of the same. This object is attained by that conical chambers are manufactured of a thin air-impermeable material and mounted behind the legs below the knees bends, or to inner rear lower portions of pants opposite to the calf muscles, so that the user during squating or kneeling supports on the elastic container and thereby distributes the body weight over the greater leg area so as to reduce the specific pressure, whereby it becomes easier for him to stand up.

DESCRIPTION OF PREFERRED EMBODIMENTS

Figure 1:
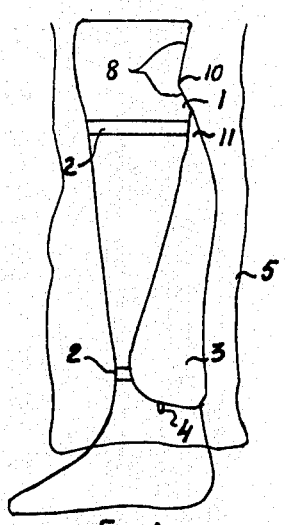
FIG. 1 is a leg which a conical bladder in non-inflated condition.

A conical chamber 3 is mounted to a rear side of legs 1 by rubber tapes 2 and is manufactured of a thin air-impermeable material, the bladder having in its lower portion a pipe 4 with a valve for inducing air into the same; all the above-mentioned parts are covered by a leg of pants 5.

Figure 6:
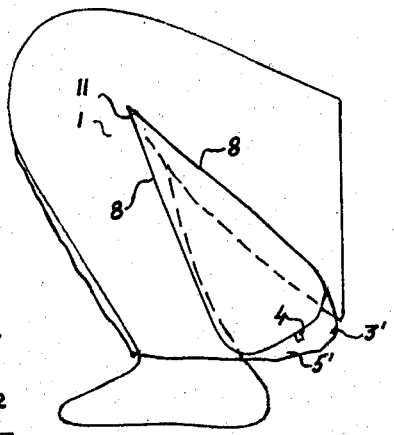
FIG. 6 is a position of a leg during squating with abutment against the inflated conical bladder attachable to the pants.
Figure 7:
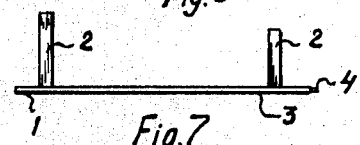
FIG. 7 is a side view of the conical bladder which is attached to a leg in non-inflated condition.
Figure 13:
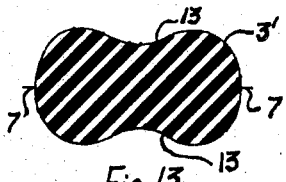
FIG. 13 is a cross section of the inflated conical bladder attachable to the pants.
Figure 10:
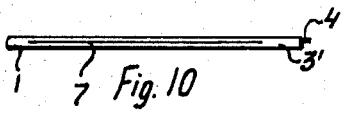
FIG. 10 is a side view of the conical chamber attachable to the inner lower rear portion of the pants, in non-inflated state.
Figure 8:
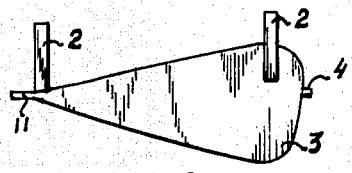
FIG. 8 is the same in inflated condition.
Figure 14:
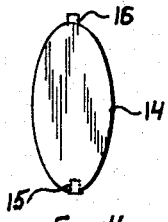
FIG. 14 is a rubber pump for inducing air into the conical bladders.
Figure 11:
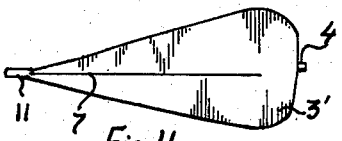
FIG. 11 is the same in the inflated condition.
Figure 9:
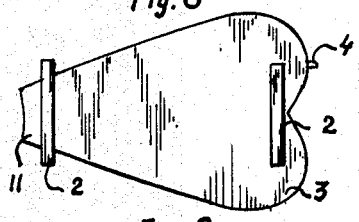
FIG. 9 is a top view of the conical bladder.
Figure 12:
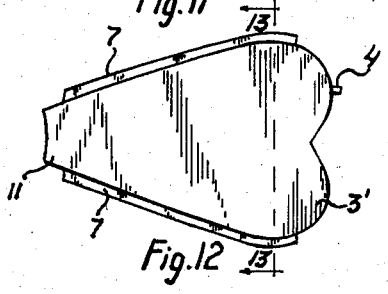
FIG. 12 is a top view of the conical bladder in non-inflated condition.

The position of the conical bladder 3' against the rear side of the leg 1 may also be performed with the aid of its mounting to an inner lower rear portion of the pants legs 5' with the aid of beads 7. Both in the first case and in the second case of mounting of the conical chambers 3 and 3' in the region of the rear side of the legs, opposite to the calf muscles, there is a possibility of squating (FIGS. 3 and 6), standing on one or two knees (FIG. 15), to transfer the body weight onto a greater area of the lower leg portions. The conical chambers 3 and 3' in the non-inflated condition are flat and light, they do not disturb a user during wearing on the legs or inner portions of pants, and are not visible from outside. In inflated condition the conical bladders are also light and can be filled with such air quantity with which it is convenient for a user to utilize, in dependence upon special situations and individual construction of legs. The conical bladders 3 and 3' has flat tongues 11 in which air does not enter; during sitting or in condition of great bend of knee joint in another posture, they are clamped by calf muscles 8 and serve for additional fixation. The cross section of the conical bladder 3' in inflated condition (FIGS. 12 and 13) have longitudinal oval recesses 13 for convenient abutment of calf muscles 8 of the leg 1. In order to induce air into the conical bladders 3 and 3' a rubber pump 14 (FIG. 14) is utilized, which has an opening with a suction valve 15 and an outer pipe 16 which can be fitted onto the pipe 4.

OPERATION OF THE DEVICE

Figure 2:
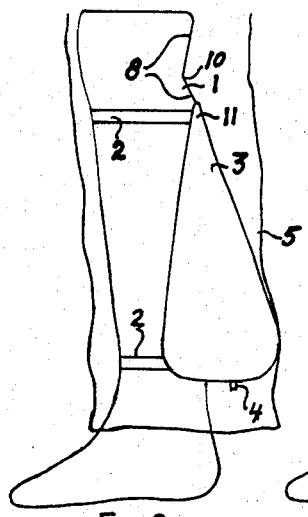
FIG. 2 is the same in inflated state.
Figure 4:
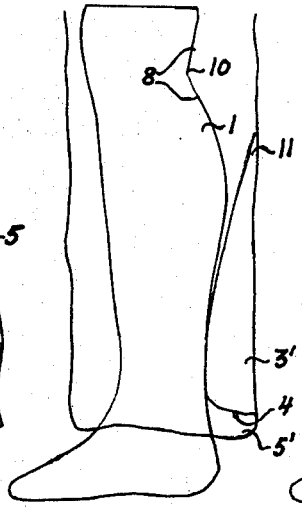
FIG. 4 is a leg and a position of a non-inflated conical bladder on a rear lower inner portion of pants.
Figure 5:
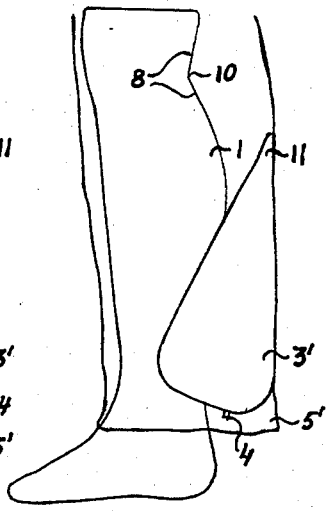
FIG. 5 is the same in non-inflated condition.
Figure 3:
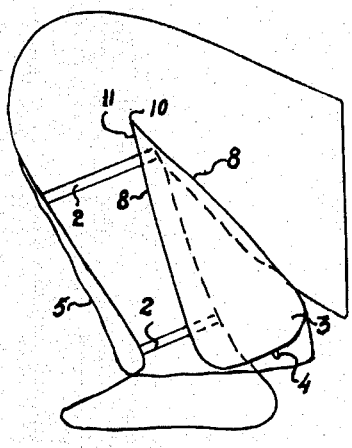
FIG. 3 is a position of a leg during squating with abutment against the inflated conical bladder.

When one wants to use the bladder 3 attachable to the leg 1, it is necessary to put it so that the tongue 11 are somewhat lower then the location of leg bend in the region of knee 10, and the rubber tapes 2 are located as shown in FIGS. 1, 2 and 3. Then the user squats and puts the rubber pump 14 so that its pipe 16 firmly abuts against the pipe 4 on the conical bladder 3; then air is induced with a quantity which provides convenience for sitting. The same is performed for the other leg. If the conical bladders are attached to the lower inner portions of pants, then a user squats so that the tongues 11 are located somewhat lower than the leg bend in the region of knees 10; then they are located between the calf muscles and inflated with air by the air pump 14 in convenient for sitting quantity.

Figure 15:
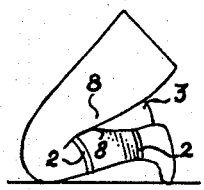
FIG. 15 is a position of the conical bladder when a user kneels with abutment via the same against the rear side of the legs.

When the inflated conical bladders 3 and 3' are located between the calf muscles 8 of the legs 1, they distribute because of their elasticity and oval recesses, the body pressure over a larger leg area, reduce specific pressure onto area unit, decreases load on the knee joints, and make possible the operations without hurting the user. In addition, the calf muscles in the case of the utilization of the conical bladders 3 and 3', abut against the surfaces of the bladders so that the user's body is somewhat higher whereby standing up from squating position or kneeling position is facilitated (FIG. 15). When it is not necessary to utilize the bladders 3 and 3' temporarily, the air issues via the pipe 4, and thereby the volume, weight or appearance of the bladder do not disturb the user.

I claim:

1. A device for facilitating squating and kneeling, comprising an inflatable bladder arranged to be located on a rear surface of a user's leg below a knee bend and movable between an operative position in which it is inflated and assumes a conical shape decreasing from a lower part of the user's leg to the leg bend in correspondence with a space between a user's calf and a user's thigh in squating or kneeling position so that a user's body is supported on thus inflated bladder while squating or kneeling, and an inoperative position in which said bladder is also located in the same region but is deflated and assumes a substantially flat shape so as not to disturb the user; and means for mounting said bladder in said region.

2. A device as defined in claim 1, wherein said conical shape of said bladder in said inflated operative position decreases to a pointed end.

3. A bladder as defined in claim 1, wherein said mounting means is arranged to mount said bladder to the user's leg.

4. A bladder as defined in claim 1, wherein said mounting means is arranged so as to mount said bladder to user's pants.

5. A device as defined in claim 1, wherein said bladder has a cross section in direction transverse to said first direction, which is provided with recess arranged to embrace the user's leg from the rear.

6. A device as defined in claim 1, wherein said bladder in said inflated condition is inflated so that it remains soft.

7. A device as defined in claim 1, wherein said bladder has a non-inflattable portion to be clamped by a leg in bent condition of the latter.

* * * * *